US005963224A

United States Patent [19]

Shimoda

[11] Patent Number: 5,963,224

[45] Date of Patent: Oct. 5, 1999

[54] RECORDING APPARATUS WITH CONTROLLED POWER SUPPLY

[75] Inventor: Akiyoshi Shimoda, Yokohama, Japan

[73] Assignee: Canon Kabushiki Kaisha, Tokyo, Japan

[21] Appl. No.: 08/046,723

[22] Filed: Apr. 16, 1993

[30] Foreign Application Priority Data

Apr. 20, 1992 [JP] Japan ..... 4-099960

[51] Int. Cl.[6] ..... B41J 2/01

[52] U.S. Cl. ..... 347/5; 347/9; 395/750; 358/442; 358/508

[58] Field of Search ..... 346/140 R, 75; 347/5, 9, 3, 14; 358/437, 439, 508, 442; 395/750

[56] References Cited

U.S. PATENT DOCUMENTS

| | | | |
|---|---|---|---|
| 4,001,839 | 1/1977 | Kraus | 346/75 |
| 4,114,750 | 9/1978 | Baeck et al. | 400/279 |
| 4,313,124 | 1/1982 | Hara . | |
| 4,338,611 | 7/1982 | Eida et al. | 346/75 |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 5,028,935 | 7/1991 | Warmack et al. | 347/205 |
| 5,323,420 | 6/1994 | Asprey | 375/214 |
| 5,428,714 | 6/1995 | Yawata et al. | 395/112 |

FOREIGN PATENT DOCUMENTS

| | | |
|---|---|---|
| 3936336 | 5/1991 | Germany . |
| 54-056847 | 5/1979 | Japan . |
| 59-123670 | 7/1984 | Japan . |
| 59-138461 | 8/1984 | Japan . |
| 60-071260 | 4/1985 | Japan . |
| 61-090221 | 5/1986 | Japan . |
| 61-121984 | 6/1986 | Japan . |
| 62-082064 | 4/1987 | Japan . |
| 63-193874 | 8/1988 | Japan . |
| 2048980 | 2/1990 | Japan . |

*Primary Examiner*—N. Le
*Assistant Examiner*—Craig A. Hallacher
*Attorney, Agent, or Firm*—Fitzpatrick, Cella, Harper & Scinto

[57] ABSTRACT

A recording apparatus comprises a recorder for receiving data from a data supplier connected through a control signal line for interface and recording an image onto a recording medium; an interface signal setting circuit which always receives an electric power from a power supply source irrespective of whether the image recording by the recorder is executed or not, thereby setting the level of the control signal line to the low level when the image recording is not executed; and a power switch for setting the mode to perform the image recording when the switch is ON and setting the mode not to perform the image recording when the switch is OFF. The recorder causes a state change in the ink by using a thermal energy which is generated from an electrothermal converter, thereby emitting an ink droplet to the recording medium and recording the image.

34 Claims, 6 Drawing Sheets

RECORDING APPARATUS WITH CONTROLLED POWER SUPPLY

BACKGROUND OF THE INVENTION

1. Field of the Invention

The present invention relates to a recording apparatus for recording an image onto a recording medium on the basis of data supplied from the outside.

2. Related Background Art

Generally, a power switch attached to the main body of an image recording apparatus is a switch to control a power supply circuit. When a power source of the image recording apparatus is ON, an electric power is supplied to a control circuit of the apparatus main body. When the power source is OFF, no electric power is supplied. However, there is an image recording apparatus such that when the power source is turned off, a special power off sequence is executed to deliver a paper or to protect a recording head, or in order to perform the protection and management by a timer circuit when the apparatus is not used (in the non-recording mode), the apparatus is controlled to a mode to execute the printing operation while supplying the power source to the control circuit or a mode not to execute the printing operation (hereinafter, such a non-printing mode is called a power off), In the specifications based on, for instance, the centronics interface standard which is most general as a printer interface specification, a data bus is connected between a data supply apparatus and an image recording apparatus and signal lines to transmit and receive the following signals and other various kinds of signals are also connected: namely, a strobe signal (latch signal of data which is generated from the data supply apparatus: this signal will be referred to as an inversion STB hereinafter); an acknowledge signal (signal to indicate that the recording apparatus can receive the next data when this signal is set to the low "L" level: this signal will be referred to as an inversion ACK hereinlater); a busy signal (signal indicating that data can be received when this signal is set to the L level: this signal will be referred to as a BUSY hereinlater); an error signal (signal indicating that the image recording apparatus is in an error state when this signal is at the L level: this signal will be referred to as an inversion ERROR hereinlater); and other various kinds of signals. The handshaking is executed among apparatuses by using the above signals and data can be accurately received.

However, in the case where the on/off operations of the power source of the image recording apparatus are controlled to a mode to execute the printing operation and a mode not to perform the printing operation instead of the on/off modes of the power supply circuit, an I/F (interface) signal is also effective even when the power source of the image recording apparatus is OFF and such a state is substantially similar to the ordinary off-line state. The data supply apparatus connected to the outside cannot discriminate whether the image recording apparatus is in the power ON state or the power OFF state.

In the data supply apparatus, in many cases, various kinds of control lines are used for the controls which the signal lines inherently mean and are also used for a purpose to monitor the power source state of the image recording apparatus.

In such an image recording apparatus, in order to inform the on/off state of the power source to the data supply apparatus connected to the outside, there is also a case where under the above power OFF state, each signal output line is set into a high impedance by the means for limiting a power source of an interface circuit, and when the apparatus is set into the pull-up state, the signal output line is set to the high "H" level, and when it is set into the pull-down state, the signal output line is set to the low "L" level, thereby preventing that the data supply apparatus side transmits the unnecessary data to the image recording apparatus, There is also an apparatus using a method whereby in addition to the use of those existing I/F signals, the signal indicative of the on/off of the power source of the image recording apparatus is additionally prepared for the special data supply apparatus and can be similarly detected.

However, even in case of using a method whereby the power supply of the interface circuit is limited and each line is held to a high impedance state or the like under the power off state of the image recording apparatus, a desired result as expected cannot always be obtained because of the following reasons, A pull-up resistor is connected to each signal line for interface of the image recording apparatus for the purposes of the protection of the input, the level matching between C-MOS and TTL, the countermeasure for delay times, the use of an open collector circuit, and the like, respectively. In addition, an input/ output gate circuit is also connected to the line without being supplied with an electric power. Consequently, the circuit is likely to be unstable in dependence on their connecting states, For example, an electric power of a certain degree is supplied to a certain signal line through the pull-up resistor of the data supply apparatus connected to the outside. Such a power component rises the potentials of the other lines through the pull-up resistor on the image recording apparatus side. There occurs a problem such that as the potential reaches a threshold value, the circuit operation becomes unstable.

Those interface signals are set on the assumption that both of the data supply apparatus and the image recording apparatus which are connected operate in the normal state as a prerequisite. No consideration is taken with respect to the case where various signal lines do not execute the inherent operations.

In the case where the signal line enters an unstable state, the data supply apparatus waits for the execution of the handshaking between the data supply apparatus and the image recording apparatus, so that there occurs a problem such that the data supply apparatus stops in a standby state and is not opened or receives wrong information or the like.

On the contrary, there is also considered a situation such that when the power source on the data supply apparatus side is OFF, an adverse influence is given by the electric power which is supplied through the pull-up resistor on the image recording apparatus side.

SUMMARY OF THE INVENTION

The present invention is made in consideration of the above problems and it is an object of the invention to provide a recording apparatus which can stabilize a power off state of an image recording apparatus when it is seen from the outside through an interface circuit.

To accomplish the above object, there is provided a recording apparatus comprising: recording means for receiving data from a data supply apparatus connected through a control signal line for interface and for recording an image onto a recording medium; and interface signal setting means for setting the level of the control signal line to the low level in the case where the image recording is not performed by always receiving an electric power supply from a power supply source irrespective of whether the image recording is executed by the recording means or not.

According to the invention to accomplish the above object, there is provided a recording apparatus comprising: recording means for receiving data from a data supply apparatus connected through a control signal line for interface and for recording an image onto a recording medium; interface signal control means for controlling the level of the control signal line by always receiving an electric power from a power supply source irrespective of whether the image recording is executed by the recording means or not; pull-up means connected between the control signal line and the power supply source; and control means for controlling the interface signal control means in a manner such that in the case where the image recording is not executed by the recording means, the power supply from the electric power source to the pull-up means is stopped and the level of the control signal line is set to the low level.

DETAILED DESCRIPTION OF THE PREFERRED EMBODIMENTS

Figure 1:
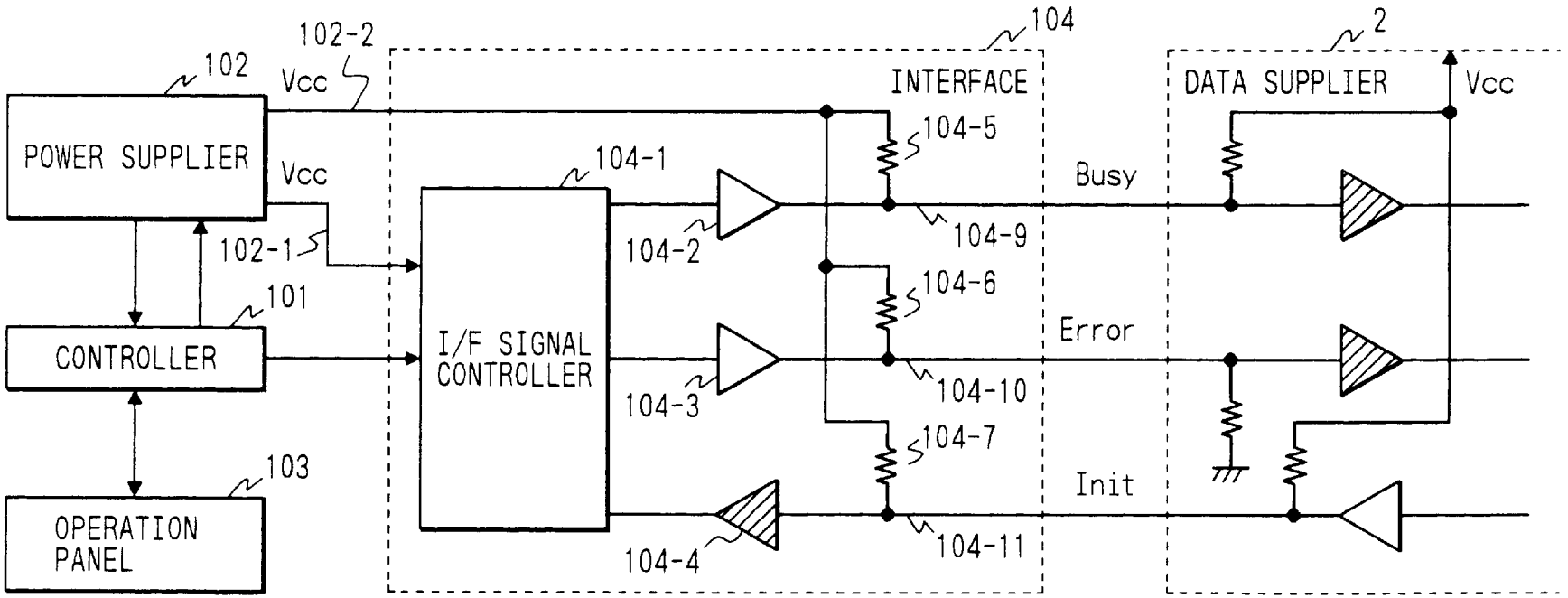
FIG. 1 is a block diagram showing an interface circuit and its peripheral circuits included in an embodiment of the present invention.

Preferred embodiments of the present invention will now be described with reference to the drawings.

The invention can be applied to a printer of any type such as laser beam printer, ink jet printer, or the like, which will be explained hereinlater, First, a construction of the ink jet printer to which the embodiment is applied will be described with reference to FIGS. 5 and 6, In FIG. 5, reference numeral 20 (IJH) denotes an ink jet head (print head) of the type such that an ink is emitted onto a recording paper by using a bubble which is generated by a thermal energy; 21 (IJC) an ink jet cartridge which is integrated with the ink jet head IJH (20) and can be freely attached or detached to/from the apparatus main body and has a tank IT (10) to supply the ink to the IJH (20); and IJRA in FIG. 6 an ink jet printer main body.

Figure 5:
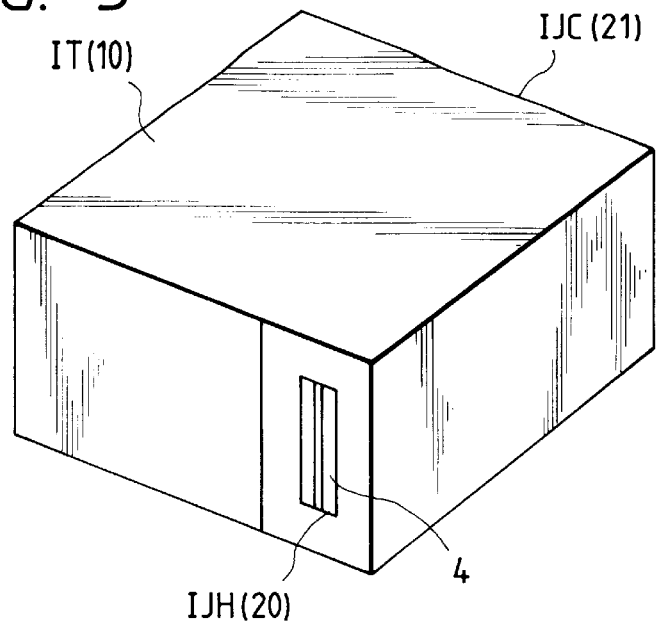
FIG. 5 is a diagram showing a print head of an ink jet printer to which the present invention can be applied.

As will be understood from a perspective view of FIG. 5, the ink jet cartridge IJC in the embodiment has a shape such that a front edge portion of the ink jet head IJH is slightly projected from the front surface of the ink tank IT. The ink jet cartridge IJC is fixedly supported to a carriage HC mounted to the printer main body IJRA. The ink jet cartridge IJC is of the disposable type such that it can be freely attached or detached to/from the carriage HC, The ink which is supplied to the ink jet head IJH is stored in the first ink tank IT (10). The ink tank IT (10) comprises an ink absorbing material, a vessel into which the ink absorbing material is inserted, and a cap member to seal the vessel (all of them are not shown). The ink is filled in the ink tank IT (10). The ink is sequentially supplied to the ink jet head side in accordance with the emission of the inks In the embodiment, a top plate 4 is made of a resin having an excellent anti-ink property such as polysulfon, polyether sulfon, polyphenylene oxide, polypropylene, or the like.

The ink jet cartridge IJC having the above structure is detachably mounted to the carriage HC of the ink jet printer IJRA, which will be explained hereinlater, by a predetermined method. By inputting a predetermined recording signal, the carriage HC and a recording medium relatively move, so that the ink jet cartridge IJC forms a desired recording image onto the recording medium.

Figure 6:
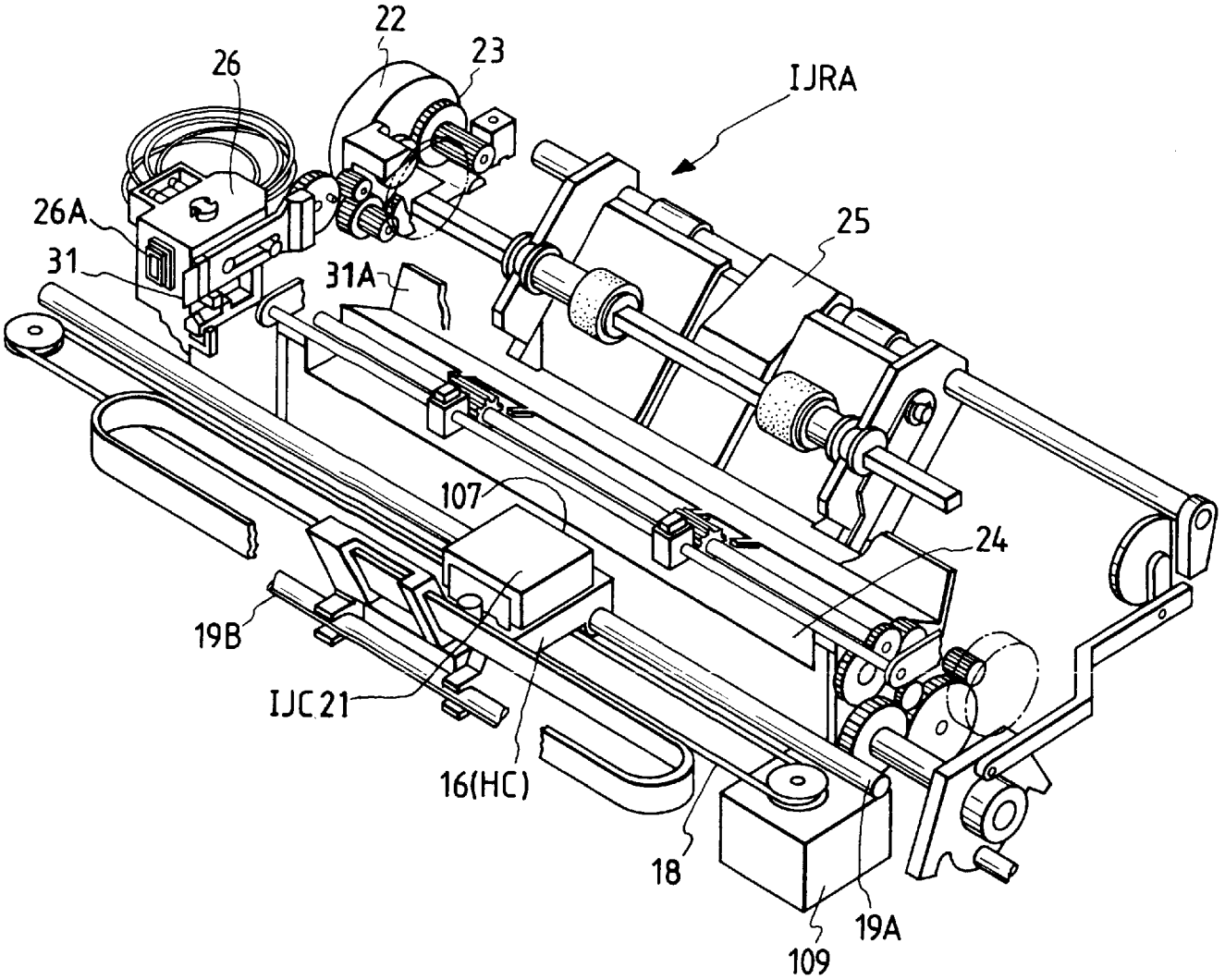
FIG. 6 is a perspective view of the ink jet printer to which the invention can be applied.

FIG. 6 is an external perspective view showing an example of the ink jet printer IJRA having the mechanism to execute the above processes.

In the diagram, reference numeral 107 denotes an ink jet head (print head) of the ink jet head cartridge IJC having an array of nozzles which are arranged so as to face the recording surface of the recording paper so as to emit the inks onto the recording surface of the recording paper conveyed onto a platen 24 by conveying means which is driven by a paper feed motor 108, which will be explained hereinlater. Reference numeral 16 denotes a carriage HC to hold the print head 107. The carriage HC is coupled with a part of a driving belt 18 to transfer a driving force of a carriage motor 109 and can slide with two guide shafts 19A and 19B arranged in parallel, thereby enabling the print head 107 to reciprocate over a whole width of the recording paper. After completion of the recording operation of one line by the print head 107, the recording paper is conveyed by a distance of a predetermined amount and the recording operation of the next line is executed.

Reference numeral 26 denotes a head recovering apparatus which is arranged at one end of the moving path of the print head 107, for instance, at the position opposite to the home position. The head recovering apparatus 26 is made operative by a driving force of a recovery motor 22 through a transfer mechanism 23, thereby capping the print head 107. In association with the capping of the print head 107 by a cap portion 26A of the head recovering apparatus 26, the ink is absorbed (absorption recovery) by proper suction means (for example, a suction pump) provided in the head recovering apparatus 26, thereby forcedly discharging the ink from the emission port (empty emission) and thereby executing an emission recovering process to eliminate the ink of an increased viscosity in the emission port. By performing the capping operation at the end of the recording operation or the like, the recording head is protected. Such an emission recovering process is executed when the power source is turned on, when the recording head is exchanged, when the recording operation is not executed for a predetermined time, or the like.

Figure 7:
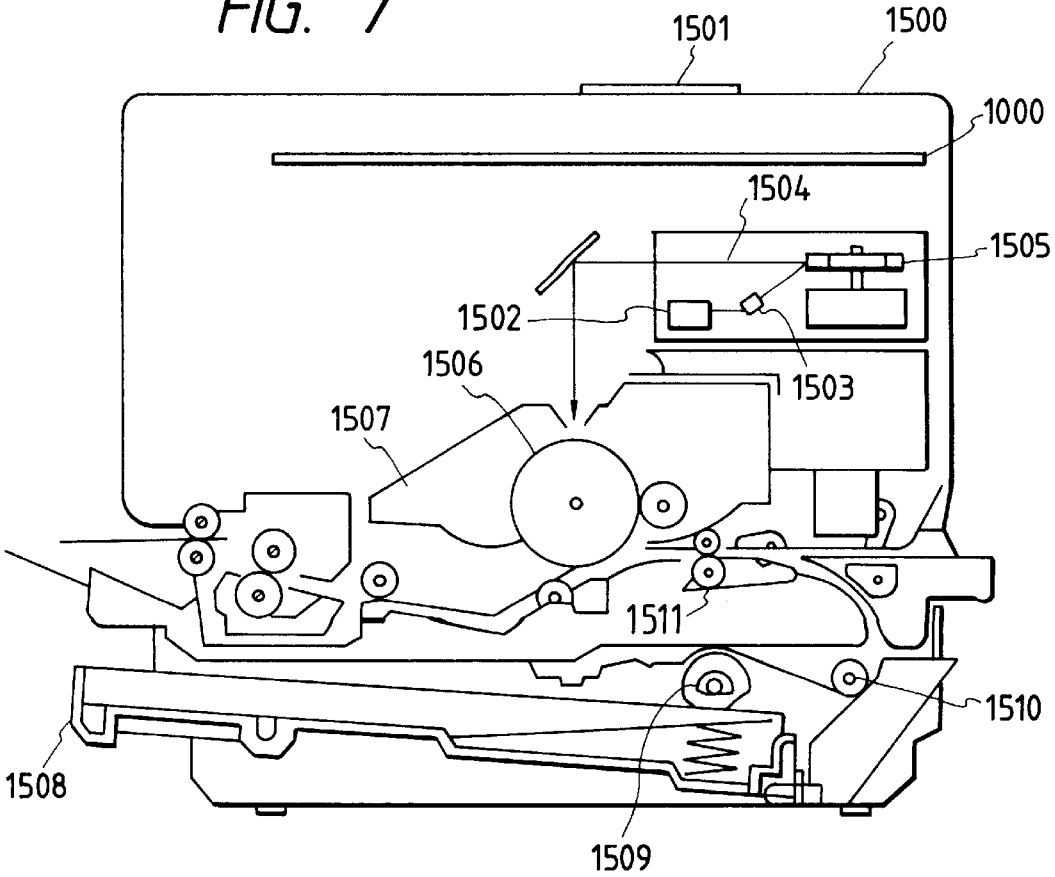
FIG. 7 is a cross sectional view of a laser beam printer to which the invention can be applied.

Reference numeral 31 denotes a blade which is arranged on the side surface of the head recovering apparatus 26 and functions as a wiping member made of silicon rubber. The blade 31 is held in a cantilever style by a blade holding member 31A and is made operative by the motor 22 and transfer mechanism 23 in a manner similar to the head recovering apparatus 26, thereby enabling the print head 107 to come into engagement with the emitting surface. Thus, the blade 31 can be projected into the moving path of the head 107 at a proper timing in the recording operation of the print head 107 or after completion of the emission recovering process using the head recovering apparatus 26. A dew condensation, wetting, dust and dirt, or the like on the emitting surface of the print head 107 is wiped out in association with the moving operation of the head 107, A construction of a laser beam printer to which the embodiment can be applied will now be described with reference to FIG. 7.

In the diagram, reference numeral 1500 denotes an LBP (laser beam printer) main body. The LBP 1500 receives and stores print information or the like which is supplied from a data supplying apparatus such as a host computer or the like connected to the outside. The LBP forms a corresponding bit map image or the like in accordance with the print information and forms the image onto the recording paper as a recording medium. Reference numeral 1501 denotes an operation panel on which a power switch for operation, an LED display, and the like are arranged; and 1000 indicates a printer control unit for controlling the whole LBP main body 1500 and for analyzing the print information or the like which is supplied from the host computer. The printer control unit 1000 converts the print information into the video signal of the bit pattern corresponding to the print information and supplies the video signal to a laser driver 1502. The laser driver 1502 is a circuit to drive a semiconductor laser 1503 and on/off switches a laser beam 1504 which is emitted from the semiconductor laser 1503 in accordance with the input video signal. The laser beam 1504 is swung to the right and left by a rotary polygon mirror 1505 and scans and exposes on an electrostatic drum 1506. Thus, an electrostatic latent image of a character pattern is formed on the drum 1506. The latent image is developed by a developing unit 1507 arranged around the drum 1506 and, after that, the developed image is copy transferred onto the recording paper. Cut sheets are used as recording papers, The cut sheet recording papers are enclosed in a paper cassette 1508 set in the LBP 1500. The cut sheets are picked up one by one and fed into the apparatus by a paper feed roller 1509 and conveying rollers 1510 and 1511 and conveyed to the drum 1506.

By applying the present invention into the above printer control unit, the operation similar to that of the foregoing ink jet printer shown in FIG. 6 can be also obviously executed.

An example of the foregoing ink jet printer will now be described in the embodiments, which will be explained hereinlater.

[Embodiment 1]

Figure 2:
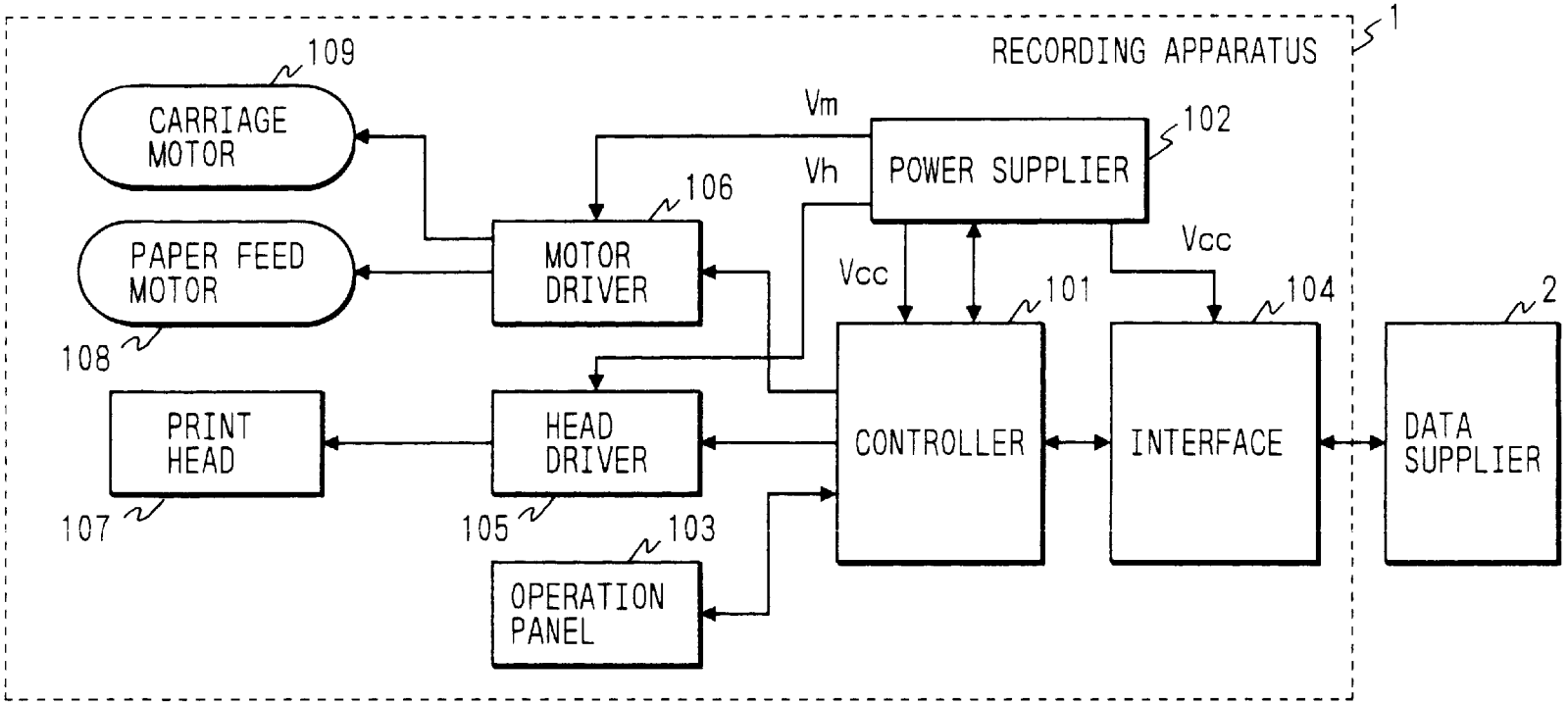
FIG. 2 is a block diagram showing a whole recording apparatus according to an embodiment of the invention.

FIG. 1 shows a specific block diagram of an interface 104, which will be explained hereinlater, in an embodiment of the present invention. FIG. 2 shows a control block diagram of the recording apparatus (ink jet printer) shown in, for example, FIG. 6. In those diagrams, similar component elements are designated by the same reference numerals.

Figure 3:
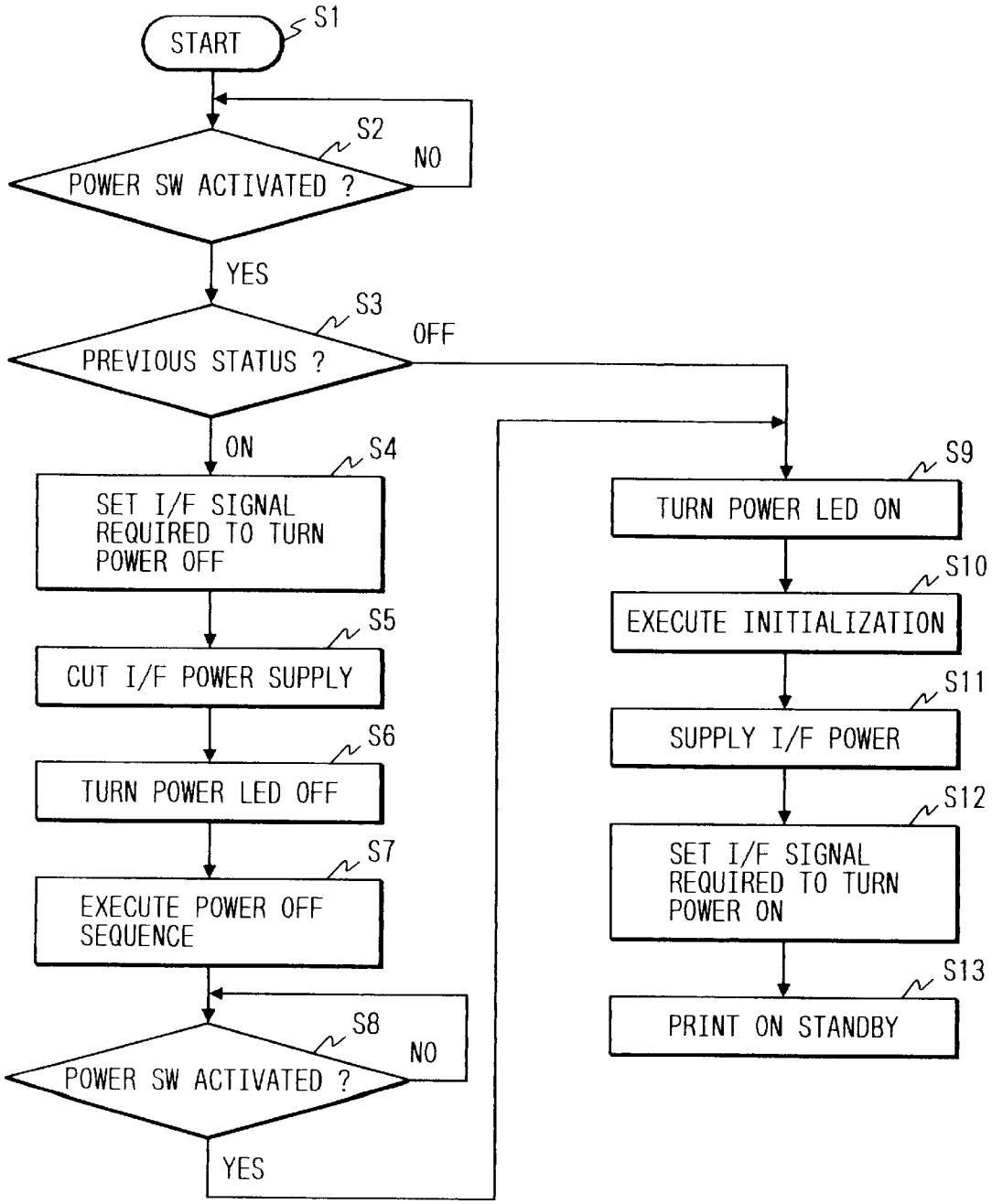
FIG. 3 is a flowchart showing an operating procedure according to the first embodiment.
Figure 4:
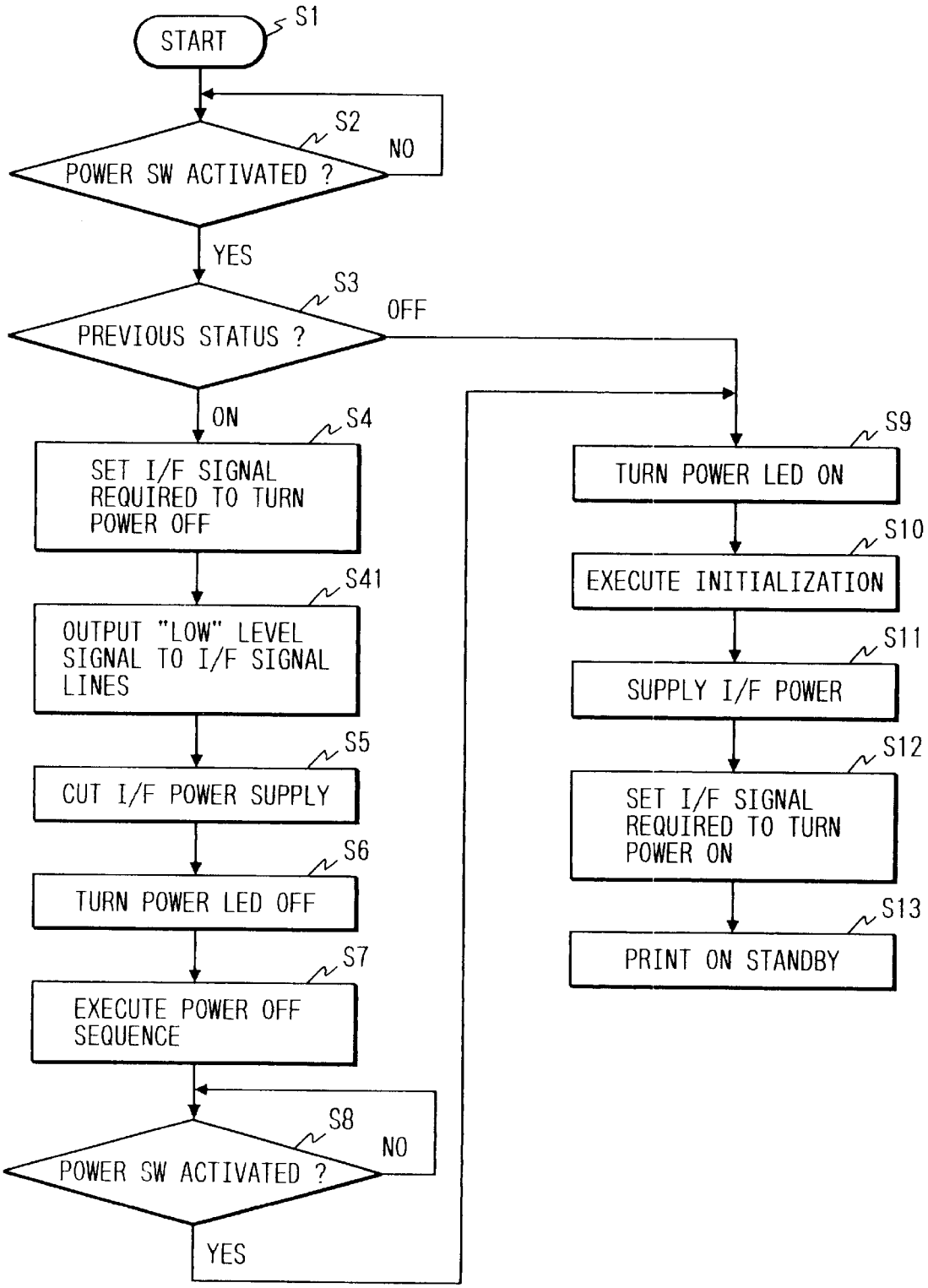
FIG. 4 is a flowchart showing an operating procedure in the second embodiment.

In FIG. 2 reference numeral 1 denotes a recording apparatus main body according to the embodiment. For instance, the recording apparatus shown in FIG. 6 can be used as the recording apparatus 1. Reference numeral 2 denotes a data supplier such as a host computer or the like connected to the recording apparatus 1 through the interface 104. Reference numeral 101 denotes a controller comprising: a CPU (not shown) to control the whole apparatus; an ROM (not shown) to store control procedures (programs) which are executed by the CPU and are shown in FIGS. 3 and 4; a RAM (not shown) which is used as a work area to store various kinds of data or the like; and the like. In accordance with the program, the CPU (not shown) in the controller 101 controls the feed motor 108, carriage motor 109, and print head 107 through a motor driver 106 and a head driver 105, thereby printing the recording data supplied from the data supplier 2. The recording data is received from the data supplier 2 via the interface 104 and is temporarily stored into an input buffer provided in the RAM (not shown) in the controller 101. After that, the recording data is read out by the CPU (not shown) in the controller 101 and is developed to the bit map data or is subjected to various kinds of print controls.

On the other hand, an operation panel 103 includes a power switch (not shown) and an LED (not shown) to display a power. The operation of the operation panel 103 is controlled by the controller 101.

An electric power is always supplied from the external power source to a power supplier 102 of the recording apparatus. Under control of the controller 101, various kinds of voltages which are necessary to the recording control, namely, $V_{cc}$ (for logic operation), $V_m$ (for driving the motor), $V_h$ (for driving the head), and the like are generated.

Returning to FIG. 1, the details of the interface 104 will now be described. In the diagram, reference numeral 104-1 denotes an I/F signal controller for generating signals to set signal lines 104-9 to 104-10 to the high/low levels in accordance with the data from the controller 101 to drivers 104-2 and 104-3 and for sending a signal which is supplied from the data supplier 2 through a signal line 104-11 to a receiver 104-4 to the controller 101. A voltage $V_{cc}$ is supplied from the power supplier 102 to the I/F signal controller 104-1 through a $V_{cc}$ line 102-1.

Each of the drivers 104-2 and 104-3 is a circuit of an open collector. Signal lines 104-9 to 104-11 of the interface 104 have been pulled up to a $V_{cc}$ line 102-2 by pull-up resistors 104-5 to 104-7.

The power supplier 102 can independently control the $V_{cc}$ lines 102-1 and 102-2. In the embodiment, an electric power which is supplied to the $V_{cc}$ line 102-2 is limited when the power source is turned off by the operation of the power switch. The $V_{cc}$ line 102-1 always continuously supplies an electric power. Further, the power supplier 102 also continuously supplies electric powers $V_{cc}$, $v_m$, and $V_h$ to the controller 101, motor driver 106, and head driver 105.

The operation of the embodiment by the CPU (not shown) will now be described with reference to a flowchart shown in FIG. 3. In step S1, a power switch detecting sequence is started. In step S2, a check is made to see if a power switch (not shown) has been depressed or not. A power switch of the on/off fixed type can be used as a power switch (not shown) on the operation panel 103. In the embodiment, however, explanation will now be made with respect to the case of using a controller which is constructed in a manner such that when the switch is operated at the time of power OFF, the power is turned on, and when the switch is operated at the time of power ON, the power is turned off.

When it is confirmed that the power switch has been operated in step S2, the state before the power switch is operated is judged in step S3. When the power has already been set to ON before the power switch is operated, this means that the user has requested the power off. Therefore, the processing routine advances to step S4 and the inversion error is activated so as not to receive the interface signal.

Explanation will now be made with respect to the case of the inversion error signal as an example. However, it is also possible to execute a similar control to at least one of the busy signal, PE signal, and other signal indicative of a state in which the recording apparatus does not accept the data for the other data suppliers.

After the I/F signal was set, step S5 follows and the limitation of the supply of the I/F electric power (namely, the stop of the supply of $V_{cc}$ to each pull-up resistor) as mentioned above is executed. In next step S6, the display of a power LED (not shown) arranged on the operation panel is turned off, thereby informing the power-off state to the user. In step S7, further, the operations generally called a power off sequence such that the print head 107 is moved to the capping position and the head is capped for protection, the recording paper in the using state is delivered to the outside of the apparatus, and the like are executed. After completion of those operations, the apparatus waits until the power switch is operated in step S8.

On the other hand, when the previous state is the power off state in step S3 or when the power switch is operated in step S8, this means that the user has requested the power on. Therefore, the power LED is turned on in step S9. In step S10, the operations which are generally called initial operation including the recovering operation of the print head, paper feeding operation, and the like are executed. In step S11, the supply of $V_{cc}$ to each of the pull-up resistors 104-9 to 104-11 of the interface 104 which is in an off state is started. The setting of the necessary I/F signal is executed in step S12. In step S13, the apparatus enters the standby mode of the printing operation.

[Embodiment 2]

FIG. 4 is a flowchart showing the operation of the embodiment 2.

In the embodiment 1, the electric power which is supplied to the pull-up section of the I/F signal is limited in the power-off state, thereby stably holding the low level of each signal line.

However, there is a drawback such that when only the above method is used, in the case where the signal lines of the apparatus which are connected to the outside have been pulled up by a low resistance value or the like, the potential of each signal line is raised through the pull-up resistor connected to each signal line in the interface, so that a sufficient low level cannot be realized.

The above drawback is improved in the embodiment 2. The whole operation and circuit construction are similar to those in the embodiment 1. The operation of the embodiment 2 will now be described with reference to the block diagram of FIG. 1 which is common to that for the embodiment 1 and the flowchart of FIG. 4 showing the operation which is unique to the embodiment 2.

A change point is that step S41 is added in FIG. 4.

In FIG. 1, the I/F signal controller 104-1 supplies signals to set the signal lines 104-9 and 104-10 to the high/low level in accordance with the data from the controller 101 to the drivers 104-2 and 104-3, respectively.

In a manner similar to the embodiment 1, in step S4, the I/F signal controller 104-1 activates the inversion error signal in accordance with the data from the controller 101, thereby indicating a state in which the recording apparatus does not accept the data. In this instance, for example, a high-level signal indicating that the data signal cannot be received is also supplied to, for example, the busy signal line 104-9.

With respect to each output signal line such as a PE signal (not shown) or the like, a signal indicative of the role of each control signal is also supplied to the output signal line in accordance with the state of the recording apparatus at that time.

In the embodiment 2, in subsequent step S41, the I/F signal controller 104-1 supplies low-level signals to the drivers 104-2 and 104-3 and to an output signal controller (not shown) in accordance with the signal from the controller 101.

Since each of the output control signals cannot perform the inherent role at the time of power off of the recording apparatus, even if it does not function as an inherent signal line after that, no problem occurs.

The processes in step S5 and subsequent steps are substantially similar to those in the embodiment 1.

Excellent effects which will be obtained by adding the process in step S41 will now be described.

As shown in FIG. 1, when the electric power supply to the interface is limited in step S5, as for the signal line, for example, 104-9 which has generated the high-level signal in the embodiment 1, the power supply to the pull-up resistor 104-5 is cut while keeping the driver 104-2 of the open collector in an open state. Therefore, the signal line 104-9 is set into the high impedance state when it is seen from the outside.

In the above output signal lines, the pull-up resistors 104-5 and 104-6 are connected in parallel with the $V_{cc}$ line 102-2 of the interface.

As shown in FIG. 1, further, the pull-up resistor is also generally connected from the $V_{cc}$ line on the data supplier side to the signal line of the data supplier connected to the outside, respectively.

In the case where the signal line on the recording apparatus side is in the high impedance state there occurs a result such that the potential of each signal line rises in dependence on the state of the signal line of the data supplier connected.

However, when the drivers 104-2 and 104-3 and the like connected to the output signal lines of the recording apparatus generate the low-level signals, a role of a short-circuit to prevent an increase in potential of each signal line can be also provided for the apparatus. The stable low level can be realized.

Moreover, since those output circuits function as short-circuit through the pull-up resistors, the input signal line from the data supplier is not directly short-circuited.

In the flowchart shown in FIG. 4, after the low-level signal was supplied as an I/F signal (S41), the I/F power supply is cut (S5). However, the above order may be also reversed and the timing to output the low level for the I/F signal can be also set to an arbitrary timing so long as the processing step is after step S3.

The present invention can provide excellent effects in the recording head and recording apparatus of the type having means (for instance, an electric/ heat converting material or a laser beam or the like) for generating a thermal energy as an energy which is used to emit the ink and a state change of the ink is caused by the thermal energy, particularly, among the ink jet recording systems. This is because according to such a method, a high density of the recording and a high fine recording can be accomplished.

As a typical construction and principle of the above apparatus, it is desirable to use the fundamental principle disclosed in, for example, the specification of U.S. Pat. No. 4,723,129 or No. 4,740,796. Such a system can be also applied to either one of what are called the on-demand type and the continuous type. However, in particular, in case of the ondemand type, at least one drive signal which gives a sudden temperature change exceeding a nucleate boiling and corresponds to the recording information is applied to an electrothermal converter arranged in correspondence to a sheet or liquid channel in which the liquid (ink) is held, thereby allowing the electrothermal converter to generate a thermal energy and causing a film boiling on the heat operating surface of the recording head. An air bubble can, consequently, be formed in the liquid (ink) which one-to-one corresponds to the driving signal, so that the above method is effective. The liquid (ink) is emitted through the opening for emission due to the growth and contraction of the air bubble, thereby forming at least one liquid droplet. By setting the driving signal in a pulse-form, the growth and contraction of the air bubble is immediately properly performed, so that the emission of the liquid (ink) of an excellent response speed can be accomplished. Therefore, such a method is more preferable. As such a pulse-shape driving signal, it is suitable to use a signal as disclosed in U.S. Pat. No. 4,463,359 or U.S Pat. No. 4,345,262. Further excellent recording can be executed by using the conditions disclosed in U.S. Pat. No. 4,313,124 of the invention regarding the temperature increase ratio of the heat operating surface.

The construction of the recording head is not limited to the combination construction (rectilinear liquid channel or right-angled liquid channel) of the emission port, liquid channel, and electrothermal converter as shown in each of the above specifications. The construction such that the heat operating portion is arranged in the bending region as disclosed in U.S. Pat. No. 4,558,333 or U.S. Pat. No. 4,459,600 is also included in the present invention. A similar effect of the invention can be also obtained even when using the construction disclosed in Japanese Laid-Open Patent Application No. 59-123670 in which a slit which is common to a plurality of electrothermal converters is used as an emitting portion of each electrothermal converter or Japanese Laid-Open Patent Application No. 59-138461 in which an opening which absorbs a pressure wave of the thermal energy is made to correspond to the emitting portion. That is, according to the present invention, the recording can be certainly efficiently executed irrespective of the type of the recording head.

Further, the invention can be also effectively applied to the recording head of the full-line type having the length corresponding to the maximum width of the recording medium which can be recorded by the recording apparatus. As such a recording head, it is possible to use any one of the construction in which such a length is satisfied by a combination of a plurality of recording heads and the construction in which one recording head is integratedly formed.

Even in case of the serial type as mentioned above, the invention can be also effectively applied to the case of using any one of the recording head fixed to the apparatus main body, the recording head of the exchangeable chip type such that by attaching the recording head to the apparatus main body, the head can be electrically connected to the apparatus main body or the ink can be supplied from the apparatus main body to the head, and the recording head of the cartridge type such that the ink tank is integratedly provided for the recording head itself.

As a construction of the recording apparatus of the embodiment, by adding emission recovering means of the recording head, spare auxiliary means, or the like, the effect of the present invention can be further stably assured, so that such a structure is preferable. Specifically speaking, the following means, which can enhance the performance of the invention, should be mentioned: namely, capping means, cleaning means, pressurizing or suction means, and electrothermal converter or another heating element for the recording head; spare heating means for heating by using a combination of those component elements; and spare emitting means for emitting the liquid independently of the recording operation.

The kinds and the number of recording heads which are mounted are also not limited to the case where, for instance, only one recording head is provided in correspondence to the ink of a single color. A plurality of recording heads can be also provided in correspondence to a plurality of inks of different recording colors and concentrations. Namely, the recording mode of the recording apparatus, for example, is not limited to only the recording mode of only a main color such as black or the like. The recording head can be integratedly formed or constructed by a combination of a plurality of heads. The invention can be also fairly effectively applied to the apparatus having at least one of the recording mode of a plurality of different colors and the recording mode of a full color by mixed colors.

Moreover, although the embodiment of the invention has been described with respect to the example in which the liquid is used as an ink, it is also possible to use an ink which is solidified at a room temperature or lower and is softened or liquefied at a room temperature. In the ink jet type, generally, the temperature of the ink itself is adjusted to a value within a range from 30 to 70° C., thereby setting the viscosity of ink to a value within a stable emitting range. Therefore, it is also possible to use the ink which is liquefied when the recording signal is applied. In addition, in order to actively prevent a temperature increase due to the thermal energy by using an energy of a state change from the solid state of the ink to the liquid state, or in order to prevent the evaporation of the ink, it is also possible to use the ink which is solidified in an ordinary state and is liquefied by the heat. The present invention can be applied to the case of using the ink having a nature such that it is liquefied for the first time by applying a thermal energy such as ink which is liquefied by applying a thermal energy in accordance with the recording signal and the liquid ink is emitted, ink such that the solidification has already been started before the ink reaches the recording medium, or the like. The ink in the above case can be formed so as to face the electrothermal converter in a state in which the ink is held as a liquid or solid ink in the concave portion or throughhole of a porous sheet as disclosed in Japanese Laid-Open Patent Application No. 54-56847 or Japanese Laid-Open Patent Application No. 60-71260. In the present invention, the film boiling method is most effective for each of the above inks.

In addition, the ink jet recording apparatus according to the embodiment is not limited to an apparatus which is used as an image output terminal of an information processing apparatus of a computer or the like. The ink jet recording apparatus can be also applied to a copying apparatus by combining with an image reader or the like or to a facsimile apparatus having a transmitting and receiving function, or the like.

According to an embodiment of the invention as described above, the system of an electric-power which is supplied to the interface is separated into two sections such as (1) input/output gates and I/F signal controller and (2) pull-up section of input/output lines. Only the electric power which is supplied to the pull-up section of each of the input/output lines is limited in association with the on/off operation of the power source of the image recording apparatus. The electric power is continuously supplied to the I/F signal controller. Due to this, the level of each line can be properly controlled.

Since the electric power of the pull-up section is not supplied to each output line using the open collector, the signal which is set into the high impedance state in the ordinary output state of the high level, for example, the signal such as an inversion error signal such that the low level indicates that data cannot be received can stably maintain the low level. Thus, the state of the image recording apparatus when it is seen from the outside through the interface is not influenced by the interface of the data supplier connected and the power-off state can be stably realized.

According to the embodiment, the electric power is divided into two systems and supplied to the interface for transmitting and receiving the signals to/from the data supplier. Therefore, the power-off state of the image recording apparatus in the case where it is seen from the outside through the interface can stably be realized.

A situation such that the electric power is supplied to the external data supplier in a state in which both of the apparatuses are not used (namely, the power sources of both of them are OFF) can be prevented.

As described above, according to the present invention, there are excellent effects such that by generating the low-level signal to a plurality of output lines when the power is off, a further stable state can be formed without providing any special short-circuit.

What is claimed is:

1. A control apparatus that communicates with an associated apparatus, said control apparatus comprising:

interface signal control means for controlling input of a signal received through a signal input line from the associated apparatus and controlling at least one signal output line that outputs a signal to the associated apparatus to go to a high signal level or a low signal level;

pull-up resistor means for pulling up the at least one signal output line;

power supply means for supplying electric power to said pull-up resistor means and for constantly supplying electric power to said interface signal control means;

input means for inputting a power off instruction; and control means, responsive to the power off instruction, for controlling said interface signal control means to control the at least one signal output line to go to a low signal level and controlling said power supply means to stop power supply to said pull-up resistor means.

2. A control apparatus according to claim 1, wherein the at least one signal output line comprise a busy signal line and an error signal line.

3. A control apparatus according to claim 1, further comprising a recording unit for performing image recording based on data supplied by the the associated apparatus.

4. A control apparatus according to claim 3, wherein said recording unit comprises an ink jet printer.

5. A control apparatus according to claim 3, wherein said recording unit comprises an electrophotographic printer.

6. A control apparatus according to claim 1, wherein said input means inputs the power off instruction provided through a power switch.

7. A control apparatus according to claim 1, further comprising means for switching to a non-printing status in response to the power off instruction.

8. A control apparatus according to claim 1, wherein said control means controls said interface signal control means to control the at least one signal output line to go to a low signal level and then controls said power supply means to stop power supply to said pull-up resistor means, in response to the power off instruction.

9. A control apparatus according to claim 1, wherein said pull-up resistor means is connected to the signal input line at the side of the associated apparatus.

10. A recording apparatus that receives data from a data supply apparatus and performs recording based on the received data, said recording apparatus comprising:

interface signal control means for controlling input of a signal received through a signal input line from the data supply apparatus and controlling at least one signal output line that outputs a signal to the data supply apparatus to go to a high signal level or a low signal level;

pull-up means for pulling up the at least one signal output line;

power supply means for supplying electric power to said pull-up means and for constantly supplying electric power to said interface signal control means;

input for inputting a power off instruction;

control means, responsive to the power off instruction, for controlling said interface signal control means to control the at least one signal output line to go to a low signal level and controlling said power supply means to stop power supply to said pull-up means; and image forming means for forming an image on a recording medium based on the data received from the data supply apparatus.

11. A recording apparatus according to claim 10, wherein the at least one signal output line comprise a busy signal line and an error signal line.

12. A recording apparatus according to claim 10 wherein said image forming means comprises an ink jet printer.

13. A recording apparatus according to claim 10, wherein said image forming means comprises an electrophotographic printer.

14. A recording apparatus according to claim 10, wherein said input means inputs the power off instruction provided through a power switch.

15. A recording apparatus according to claim 10, wherein said recording apparatus is placed in a non-printing status in response to the power off instruction.

16. A recording apparatus according to claim 10, wherein said control means controls said interface signal control means to control the at least one signal output line to go to a low signal level and then controls said power supply means to stop power supply to said pull-up means, in response to the power off instruction.

17. A recording apparatus according to claim 10, wherein said pull-up means is connected to the signal input line at the side of the data supply apparatus.

18. A control method for communicating with an associated apparatus, said control method comprising the steps of:

controlling, with an interface signal control circuit, input of a signal received through a signal input line from the associated apparatus and controlling at least one signal output line that outputs a signal to the associated apparatus to go to a high signal level or a low signal level;

pulling up the at least one signal output line with a pull-up resistor;

supplying electric power to the pull-up resistor and constantly supplying electric power to the interface signal control circuit with a power supply circuit;

inputting a power off instruction; and controlling, in response to the power off instruction, the interface signal control circuit to control the at least one signal output line to go to a low signal level and controlling the power supply circuit to stop power supply to the pull-up resistor.

19. A control method according to claim 18, wherein the at least one signal output line comprise a busy signal line and an error signal line.

20. A control method according to claim 18, further comprising the step of performing image recording with a recording unit based on data supplied by the associated apparatus.

21. A control method according to claim 20, wherein the recording unit comprises an ink jet printer.

22. A control method according to claim 13, wherein the recording unit comprises an electrophotographic printer.

23. A control method according to claim 18, wherein said inputting step inputs the power off instruction provided through a power switch.

24. A control method according to claim 18, wherein a non-printing status is established in response to the power off instruction.

25. A control method according to claim 18, wherein the control circuit controls the interface signal control circuit to control the at least one signal output line to go to a low signal level and then controls the power supply circuit to stop power supply to the pull-up resistor, in response to the power off instruction.

26. A control method according to claim 25, wherein the pull-up resistor is connected to the signal input line at the side of the associated apparatus.

27. A recording method for receiving data from a data supply apparatus and performing recording based on the received data, said recording method comprising the steps of:

controlling, with interface signal control means, input of a signal received through a signal input line from the data supply apparatus and controlling at least one signal output line that outputs a signal to the data supply apparatus to go to a high signal level or a low signal level;

pulling up the at least one signal output line with pull-up means;

supplying electric power to the pull-up means and constantly supplying electric power to the interface signal control means with power supply means;

inputting a power off instruction;

controlling with control means, in response to the power off instruction, the interface signal control means to control the at least one signal output line to go to a low signal level and controlling the power supply means to stop power supply to the pull-up means; and forming an image on a recording medium based on the data supplied from the data supply apparatus.

28. A recording method according to claim 27, wherein the at least one signal output line comprise a busy signal line and an error signal line.

29. A recording method according to claim 27, wherein said image forming step is effected with an ink jet printer.

30. A recording method according to claim 27, wherein said image forming step is effected with an electrophotographic printer.

31. A recording method according to claim 27, wherein said step of inputting the power off instruction is provided through a power switch.

32. A recording method according to claim 27, wherein a non-printing status is established in response to the power off instruction.

33. A recording method according to claim 27, wherein the control means controls the interface signal control means to control the at least one signal output line to go to a low signal level and then controls the power supply means to stop power supply to the pull-up means, in response to the power off instruction.

34. A recording method according to claim 27, wherein the pull-up means is connected to the signal input line at the side of the data supply apparatus.

* * * * *

UNITED STATES PATENT AND TRADEMARK OFFICE

CERTIFICATE OF CORRECTION

PATENT NO. : 5,963,224

DATED : October 5, 1999

INVENTOR(S) : AKIYOSHI SHIMODA

It is certified that error appears in the above-identified patent and that said Letters Patent is hereby corrected as shown below:

Title page, item

[56] References Cited:
FOREIGN PATENT DOCUMENTS, "2048980" should read --2-48980--.

COLUMN 8:
Line 58, "ondemand" should read --on-demand--.

COLUMN 12:
Line 25, "claim 10" should read --claim 10,--.

COLUMN 13:
Line 7, "claim 13," should read --claim 20,--.

Signed and Sealed this

Twenty-fifth Day of July, 2000

*Attest:*

*Attesting Officer*

Q. TODD DICKINSON

*Director of Patents and Trademarks*